US012428765B1

(12) United States Patent
Hallstedt

(10) Patent No.: US 12,428,765 B1
(45) Date of Patent: Sep. 30, 2025

(54) PIVOTING LOWER ARM FOR ROBOTIC SEWING ASSEMBLY

(71) Applicant: INTEVA PRODUCTS, LLC, Troy, MI (US)

(72) Inventor: Nicholas Hallstedt, Sterling Heights, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 0 days.

(21) Appl. No.: 18/890,347

(22) Filed: Sep. 19, 2024

Related U.S. Application Data

(60) Provisional application No. 63/571,783, filed on Mar. 29, 2024.

(51) Int. Cl.
*D05B 73/06* (2006.01)
*D05B 3/00* (2006.01)

(52) U.S. Cl.
CPC ..... *D05B 73/06* (2013.01); *D05B 3/00* (2013.01)

(58) Field of Classification Search
CPC ..... D05B 3/02; D05B 19/14; D05B 15/00; D05B 15/02; D05B 3/04; D05B 21/00; D05B 25/00; D05B 69/28; D05B 73/00; D05B 73/02; D05B 73/04; D05B 73/06; D05B 73/08; D05B 73/10; D05B 73/12
See application file for complete search history.

(56) References Cited

U.S. PATENT DOCUMENTS 1,572,957 A * 2/1926 Reed ..... D05B 15/04 112/62
2,716,387 A * 8/1955 Heinrich ..... D05B 81/00 112/62
5,313,897 A * 5/1994 Katamine ..... D05B 73/00 112/470.13
5,875,726 A * 3/1999 Keilmann ..... B25J 9/0084 112/475.08
7,363,869 B1 * 4/2008 Yang ..... D05B 15/02 112/62

(Continued)

FOREIGN PATENT DOCUMENTS

EP 699794 A1 * 3/1996 ..... B25J 9/0084

OTHER PUBLICATIONS

Office Action issued in German Patent Application No. 202025101460.2; Date of Mailing May 30, 2025 (1 page).

(Continued)

*Primary Examiner* — Danny Worrell
(74) *Attorney, Agent, or Firm* — CANTOR COLBURN LLP

(57) ABSTRACT

A robotic sewing assembly is provided and includes a sewing head body, an upper arm, a motor and a lower arm. The upper arm is attachable to the sewing head body and includes a sewing needle oriented along a first axis. The lower arm is rotatably attachable to the sewing head body to be rotatable about a second axis defined transversely with respect to the first axis by the motor. The lower arm includes a stitch plate, a butterfly looper and first and second drivetrains. The first drivetrain is extendable through the lower arm and configured to maintain a position of the stitch plate during lower arm rotation. The second drivetrain is extendable through the lower arm and configured to drive the butterfly looper during the lower arm rotation.

20 Claims, 9 Drawing Sheets

(56) References Cited

U.S. PATENT DOCUMENTS

| | | | | |
|---|---|---|---|---|
| 10,240,271 | B2 * | 3/2019 | Freer | D05B 23/00 |
| 11,578,440 | B2 * | 2/2023 | Wendel | D05B 69/12 |
| 2013/0008362 | A1 * | 1/2013 | Wenzel | B60N 2/5891 112/53 |
| 2016/0096490 | A1 * | 4/2016 | Wenzel | D05B 1/08 112/202 |
| 2023/0193539 | A1 * | 6/2023 | Watanabe | D05B 27/02 112/185 |

OTHER PUBLICATIONS

Office Action (Incorporation by Reference) issued in French Application No. 2503158; Date of Mailing Jul. 18, 2025 (4 pages).
Office Action (Lack of Clarity) issued in French Application No. 2503158; Date of Mailing Jul. 18, 2025 (4 pages).

* cited by examiner

PIVOTING LOWER ARM FOR ROBOTIC SEWING ASSEMBLY

CROSS-REFERENCE TO RELATED APPLICATIONS

This application claims the benefit of U.S. Provisional Application No. 63/571,783 filed Mar. 29, 2024, the disclosure of which is incorporated herein by reference in its entirety.

BACKGROUND

Exemplary embodiments of the present disclosure pertains to the art of robotic sewing assemblies for use in sewing processes.

Current robotic sewing technology often includes a sewing head with a lower arm post that is fixed in position (i.e., a fixed-position lower arm post). Due to the presence of the lower arm post and the fact that the lower arm post is fixed in position, it is often the case that the lower arm post makes sewing parts with complex geometries difficult. During sewing operations for parts with complex geometries, the lower arm post can impinge against the part itself or otherwise prevent the sewing head from accessing certain portions of the part. In these or other cases, the sewing head need to be adjusted or readjusted in order to allow the sewing head to complete the sewing operation.

In the manual sewing industry, especially within footwear and bag or luggage manufacturing, pivoting lower arm technology has been used. No such technology is available in robotic sewing technology.

SUMMARY

According to an aspect of the disclosure, a robotic sewing assembly is provided and includes a sewing head body, an upper arm, a motor and a lower arm. The upper arm is attachable to the sewing head body and includes a sewing needle oriented along a first axis. The lower arm is rotatably attachable to the sewing head body to be rotatable about a second axis defined transversely with respect to the first axis by the motor. The lower arm includes a stitch plate, a butterfly looper and first and second drivetrains. The first drivetrain is extendable through the lower arm and configured to maintain a position of the stitch plate during lower arm rotation. The second drivetrain is extendable through the lower arm and configured to drive the butterfly looper during the lower arm rotation.

In accordance with additional and/or alternative embodiments, the upper arm, the sewing needle and the lower arm define an empty internal sewing region.

In accordance with additional and/or alternative embodiments, the lower arm is rotatable through 160 degrees of rotation about the second axis.

In accordance with additional and/or alternative embodiments, the lower arm and the first and second drivetrains are correspondingly U-shaped.

In accordance with additional and/or alternative embodiments, at least one of the first and second drivetrains includes concentric shafts.

In accordance with additional and/or alternative embodiments, a counterweight is disposable to reduce a lower arm torque requirement.

In accordance with additional and/or alternative embodiments, a bearing is supportively disposable on the sewing head body for lower arm support against the sewing head body.

In accordance with additional and/or alternative embodiments, wings are extendable outwardly from the sewing head body and roller bearings are attachable to the lower arm for lower arm support against the wings during the lower arm rotation.

In accordance with additional and/or alternative embodiments, a programmable control system is configured to robotically control the sewing head body, the upper arm, the lower arm and the lower arm rotation. The programmable control system includes a sensor system to gage distance between the lower arm and an article being sewn and the programmable control system is configured to modify a programmed operation of the sewing head body, the upper arm, the lower arm and the lower arm rotation in accordance with readings of the sensor system.

According to an aspect of the disclosure, a robotic sewing assembly is provided and includes a sewing head body, an upper arm, a motor, a lower arm rotation drivetrain and a lower arm. The upper arm is attachable to the sewing head body and includes a sewing needle oriented along a first axis. The lower arm is rotatably attachable to the sewing head body to be rotatable about a second axis defined transversely with respect to the first axis by the motor via the lower arm rotation drivetrain. The lower arm includes a stitch plate, a butterfly looper and first and second drivetrains. The first drivetrain is extendable through the lower arm and configured to maintain a position of the stitch plate during lower arm rotation. The second drivetrain is extendable through the lower arm and configured to drive the butterfly looper during the lower arm rotation.

In accordance with additional and/or alternative embodiments, the upper arm, the sewing needle and the lower arm define an empty internal sewing region.

In accordance with additional and/or alternative embodiments, the lower arm is rotatable through 160 degrees of rotation about the second axis.

In accordance with additional and/or alternative embodiments, the lower arm and the first and second drivetrains are correspondingly U-shaped.

In accordance with additional and/or alternative embodiments, at least one of the first and second drivetrains includes concentric shafts.

In accordance with additional and/or alternative embodiments, a counterweight is disposable to reduce a lower arm torque requirement.

In accordance with additional and/or alternative embodiments, a bearing is supportively disposable on the sewing head body for lower arm support against the sewing head body.

In accordance with additional and/or alternative embodiments, wings are extendable outwardly from the sewing head body and roller bearings are attachable to the lower arm for lower arm support against the wings during the lower arm rotation.

In accordance with additional and/or alternative embodiments, a programmable control system is configured to robotically control the sewing head body, the upper arm, the lower arm and the lower arm rotation. The programmable control system includes a sensor system to gage distance between the lower arm and an article being sewn. The programmable control system is configured to modify a programmed operation of the sewing head body, the upper arm, the lower arm and the lower arm rotation in accordance with readings of the sensor system.

According to an aspect of the disclosure, a method of operating a robotic sewing assembly is provided and includes programming the robotic sewing assembly to execute a sewing operation with respect to an article and driving the robotic sewing assembly in accordance with the programming. The driving includes operating an upper arm including a sewing needle oriented along a first axis, rotating a lower arm about a second axis defined transversely with respect to the first axis, driving a first drivetrain extending through the lower arm to maintain a position of a stitch plate of the lower arm during the rotating of the lower arm and driving a second drivetrain extending through the lower arm to drive a butterfly looper of the lower arm during the rotating of the lower arm.

In accordance with additional and/or alternative embodiments, the method further includes sensing a distance between the lower arm and the article, determining whether the distance is less than a predetermined distance and, in an event the distance is less than the predetermined distance, modifying the driving of the robotic sewing head in accordance with the programming to increase the distance.

Additional features and advantages are realized through the techniques of the present disclosure. Other embodiments and aspects of the disclosure are described in detail herein and are considered a part of the claimed technical concept. For a better understanding of the disclosure with the advantages and the features, refer to the description and to the drawings.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1A:
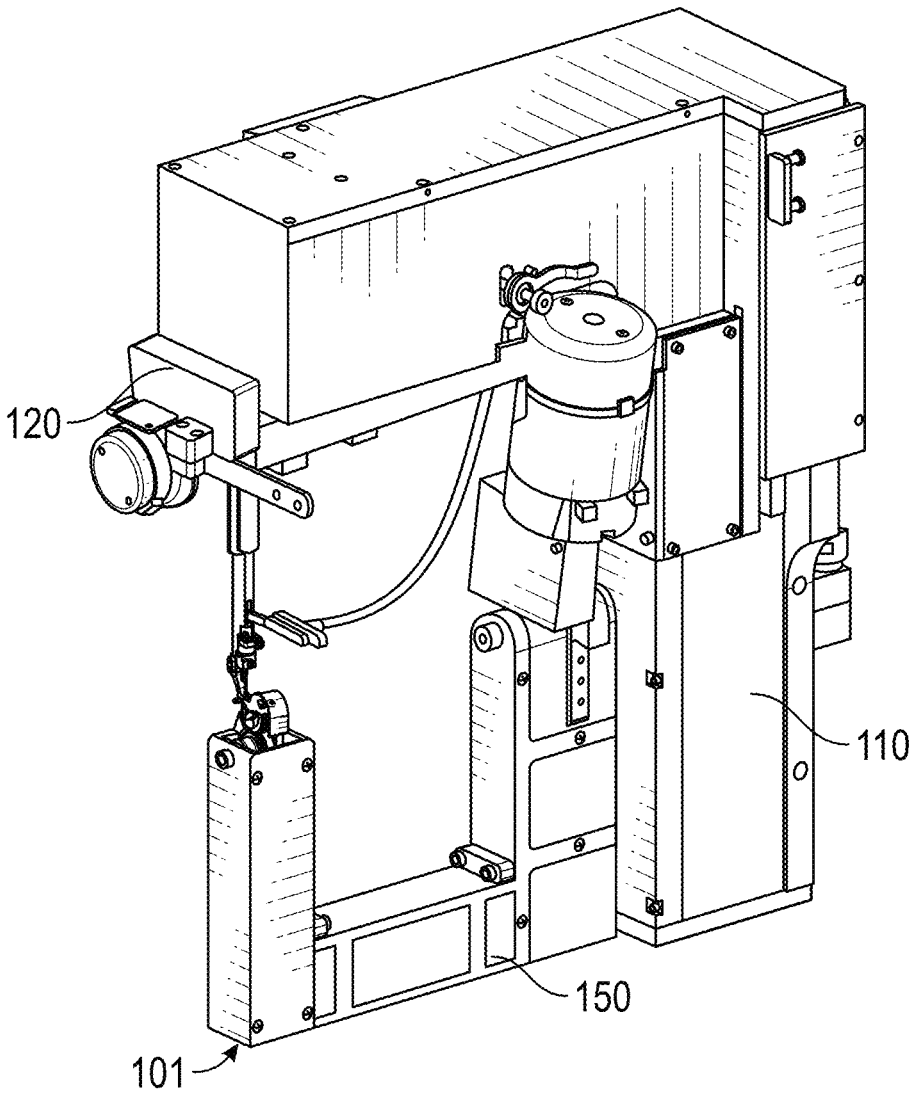
FIGS. 1A, 1B and 1C are perspective views of a robotic sewing assembly including a rotatable lower arm in accordance with embodiments.

A detailed description of one or more embodiments of the disclosed apparatus and method are presented herein by way of exemplification and not limitation with reference to the Figures.

The present disclosure provides the ability to sew complex 3D planar parts with a robotic sewing cell as opposed to robotic sewing technology including a sewing head with a fixed-position lower arm post. Whereas a robotic sewing head with a fixed position post can be limited in its ability to sew parts with complex geometries, the present disclosure provides for a robotic sewing assembly with a lower arm that is rotatable about a horizontal axis. The rotatability of the lower arm makes it possible to rotate the lower arm about the horizontal axis while maintaining stitch plate position relative to the upper portion of the sewing head while actively sewing a part. Thus, as the part is being sewn, the lower arm can be maneuvered and repositioned to optimize the sewing head to fit the part geometry. The complex 3D planar parts can be instrument panels (IPs) for vehicles.

With reference to FIGS. 1A, 1B and 1C and FIG. 2, a robotic sewing assembly 101 is provided and includes a sewing head body 110, an upper arm 120 that is attached to the sewing head body 110 and includes a sewing needle 121 oriented along a first axis A1 and a foot 122 through which the sewing needle 121 extends, a motor 130, a lower arm rotation drivetrain 140 and a lower arm 150. The lower arm 150 is rotatably attached to the sewing head body 110 to be rotatable about a second axis A2. The second axis A2 is defined transversely or perpendicularly with respect to the first axis A1. Rotation of the lower arm 150 is drivable by the motor 130 via the lower arm rotation drivetrain 140.

The lower arm rotation drivetrain 140 includes a spur gear 141 and pinion gear 142 set and a right-angle gearbox 143 paired with the motor 130. The motor 130 drives the right-angle gearbox 143 and the right-angle gearbox 143 in turn drives the spur gear 141 via the pinion gear 142. The spur gear 141 is fixed to the lower arm 150 such that, with the spur gear 141 driven by the pinion gear 142, the lower arm 150 is caused to rotate about the second axis A2. The lower arm 150 is mounted to a horizontal mid-shaft 144, which protrudes from post section 145 of the sewing head body 110. The lower arm 150 can be mounted on a sleeve bearing such that the lower arm 150 is supported by but does not move with rotation of the horizontal mid-shaft 144.

In accordance with embodiments, the horizontal mid-shaft 144 can have a diameter of up to 16 mm or more to improve mechanism integrity and rigidity.

The lower arm 150 includes a stitch plate 160, a butterfly looper 170, a first drivetrain 180 and a second drivetrain 190. The first drivetrain 180 is extendable through an interior of the lower arm 150 and is configured to maintain a position of the stitch plate 160 relative to the sewing needle 121 during rotation of the lower arm 150. The second drivetrain 190 is extendable through the interior of the lower arm 150 and is configured to drive the butterfly looper 170 during the rotation of the lower arm 150.

In accordance with embodiments, the lower arm 150, the first drivetrain 180 and the second drivetrain 190 can be correspondingly U-shaped. As such, the upper arm 120, the sewing needle 121, the foot 122 and the lower arm 150 cooperatively define a substantially empty internal sewing region 201. This substantially empty internal sewing region 201 provides for ample space for accommodating portions of an article, such as an IP, being sewn. The rotatability of the lower arm 150 effectively increases a size and utility of the substantially empty internal sewing region 201 by providing for movement of the lower arm 150 out of the way of the article during certain sewing operations.

The stitch plate 160 is free-floating on a horizontal shaft. The first drivetrain 180 includes a bevel gear 181, a set of interconnected shafts 182 and a connection gear 183 disposed underneath the stitch plate 160 and to which the set of interconnected shafts 182 connect. The bevel gear 181 is fixed to the sewing head body 110. As the lower arm 150 rotates about the horizontal mid-shaft 144, the bevel gear 181 drives the set of interconnected shafts 182 and the set of interconnected shafts 182 in turn drive the connection gear 183. As the lower arm 150 and the set of interconnected shafts 182 rotate, the connection gear 183 can be driven in a 1:1 ratio with respect to the lower arm 150. Therefore, as the lower arm 150 rotates, the stitch plate 160 rotates relative to the lower arm 150 and maintains its rotational position relative to the sewing needle 121, the foot 122 and rest of the sewing head body 110.

Figure 1B:
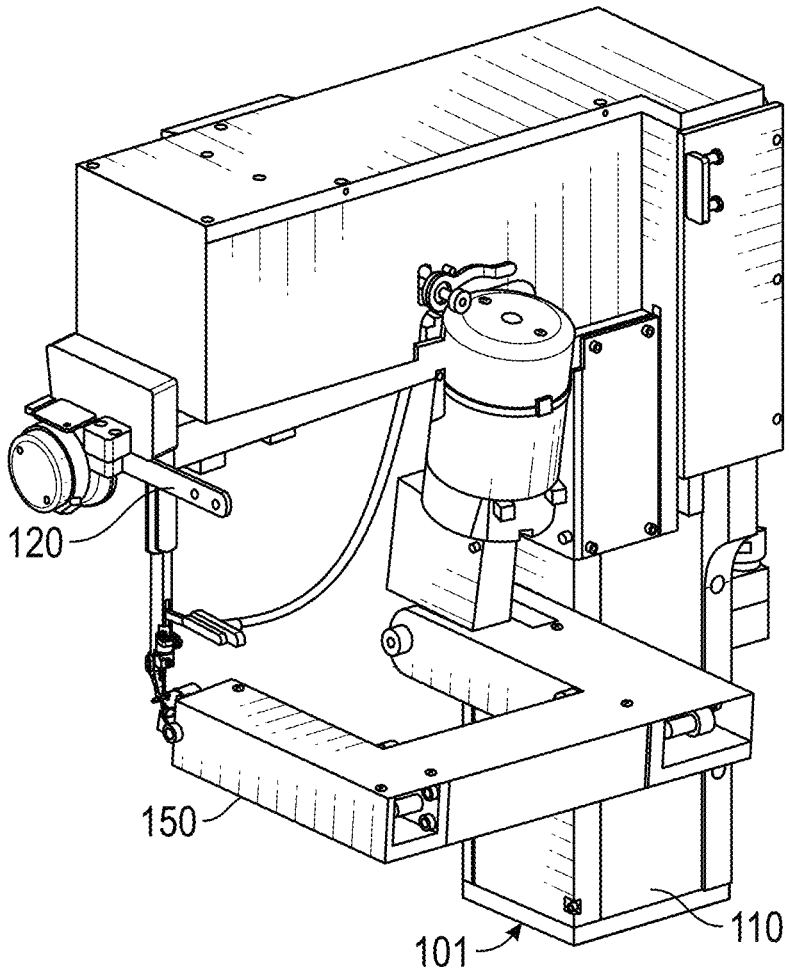
Figure 1C:
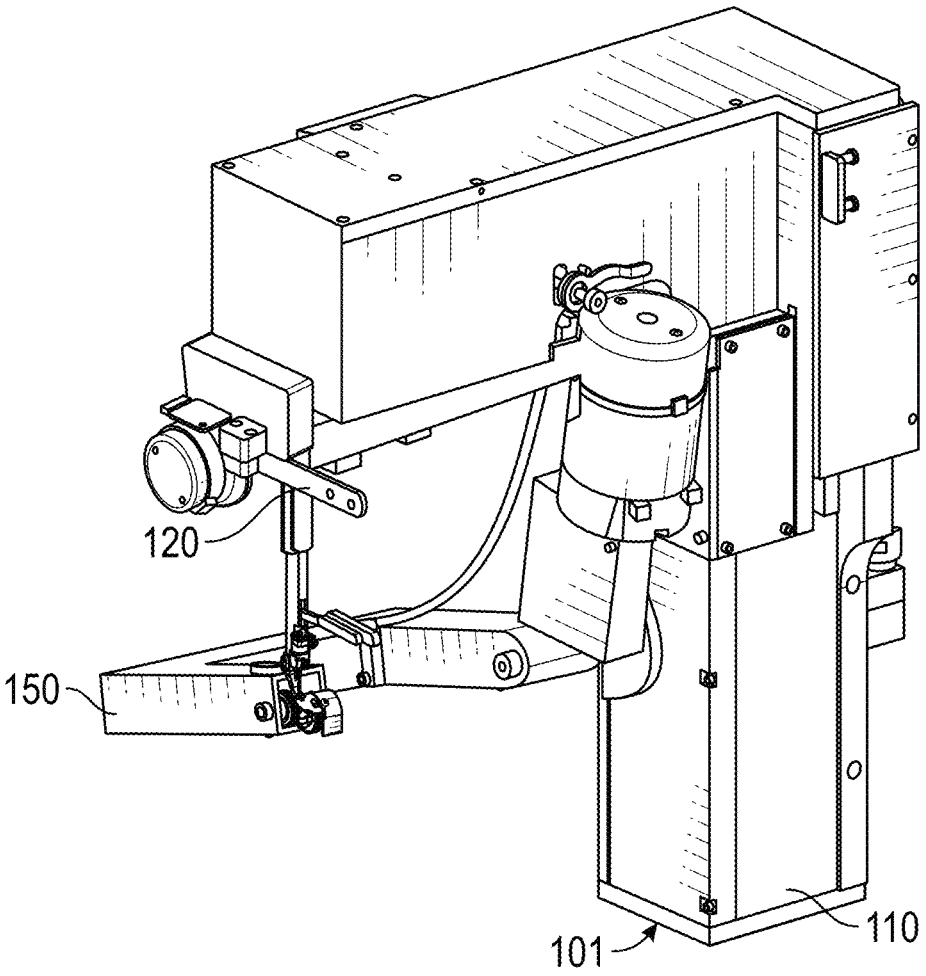

In accordance with embodiments and as shown in FIGS. 1A, 1B and 1C, the lower arm 150 is rotatable through up to 160 degrees of rotation or more about the second axis A2. That is, the lower arm 150 can be rotated clockwise through up to 80 degrees of rotation or more about the second axis A2 from a center position (see FIG. 1B) and the lower arm 150 can be rotated counter-clockwise through up to 80 degrees of rotation or more about the second axis A2 from the center position (see FIG. 1C).

The butterfly looper 170 can be a butterfly-style looper that moves via continuous rotary motion. This stands in contrast to conventional sickle loopers and lockstitch mechanisms that are often used in most robotic sewing heads. The butterfly looper 170 was chosen over a lockstitch mechanism due to its compact packaging, ease of integration into the lower arm 150 and benefits of using chainstitch over lockstitch.

Figure 2:
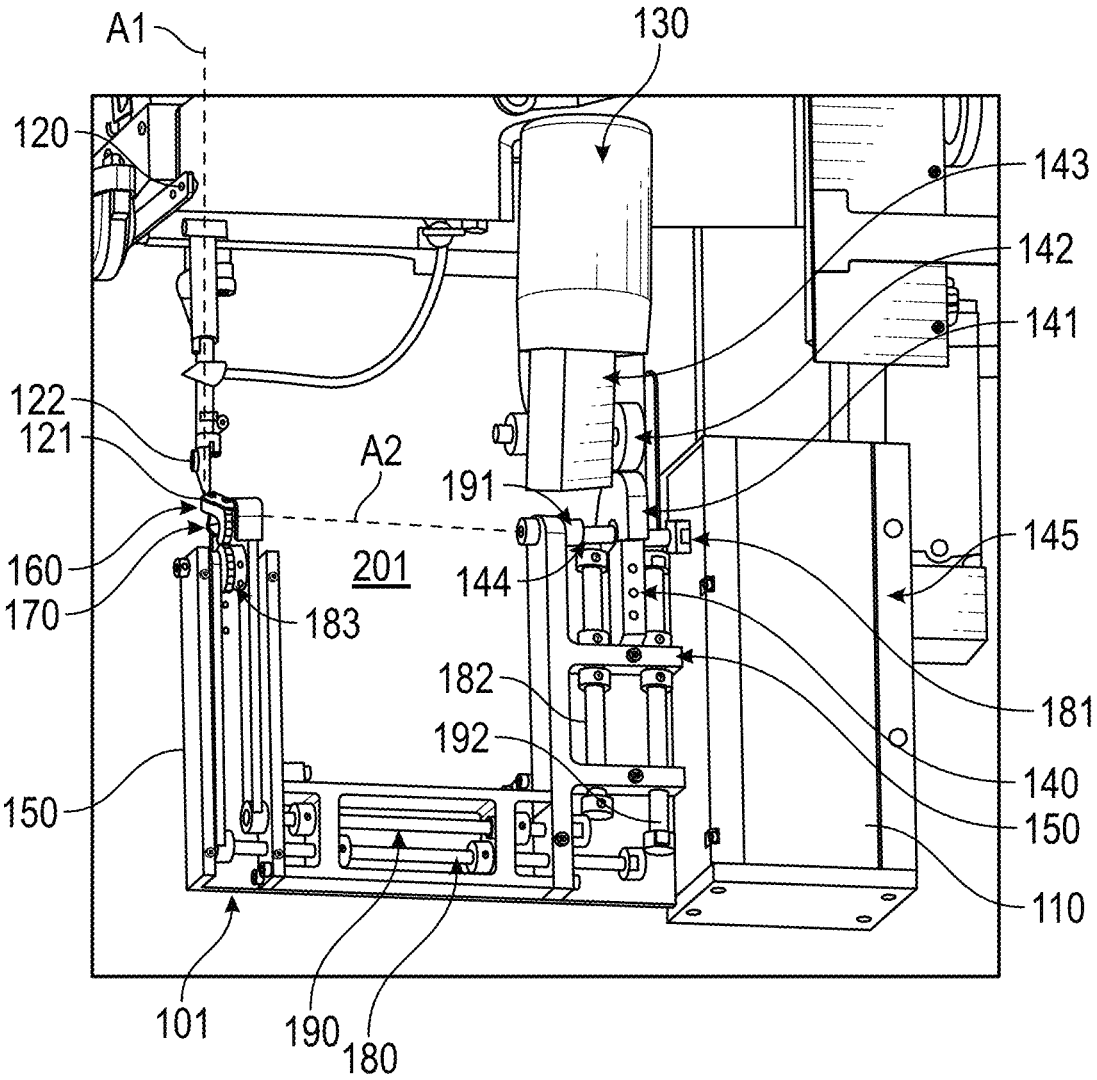
FIG. 2 is an enlarged and partially cutaway perspective view of portions of the robotic sewing assembly including the rotatable lower arm of FIG. 1 in accordance with embodiments.
Figure 3A:
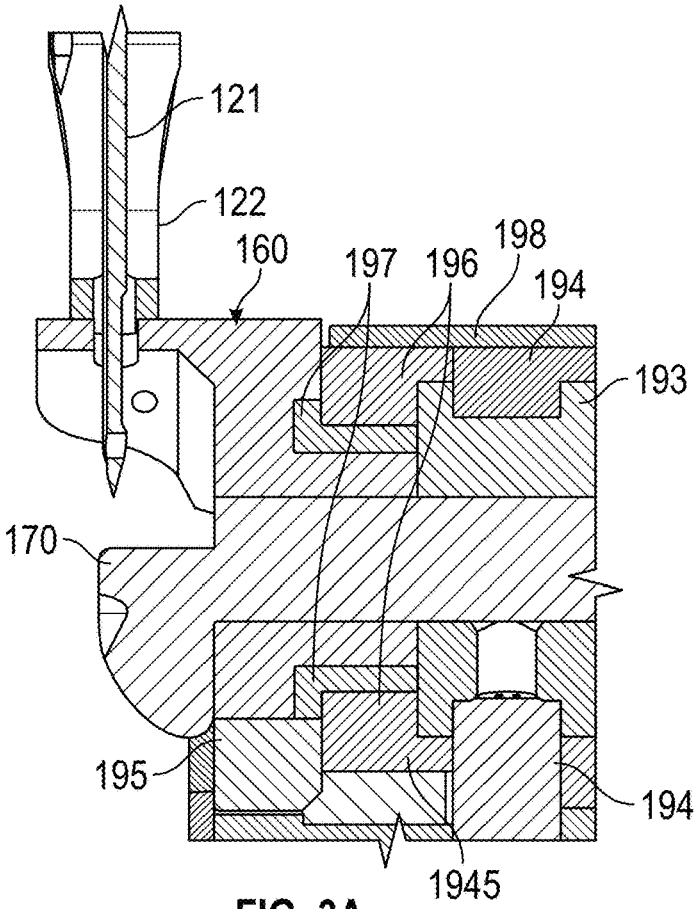
FIGS. 3A, 3B and 3C are side views of a sewing needle and a stitch plate assembly of the robotic sewing assembly of FIGS. 1 and 2 in accordance with embodiments.
Figure 3B:
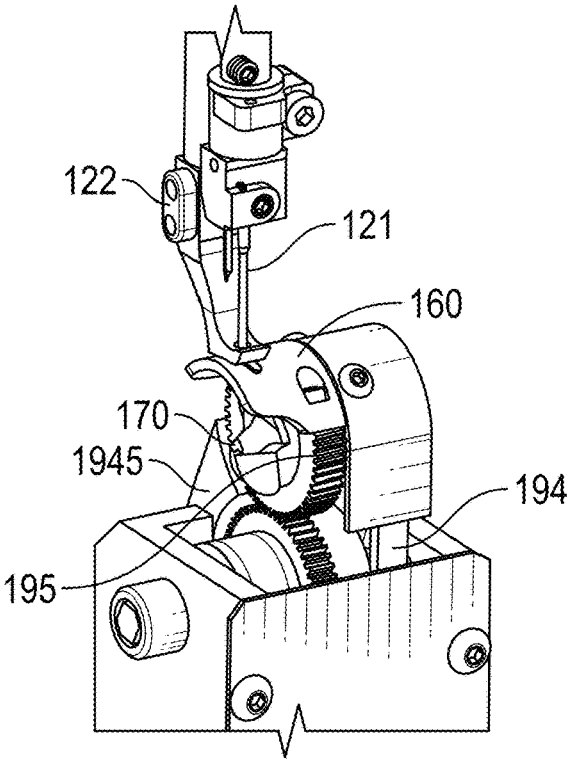
Figure 3C:
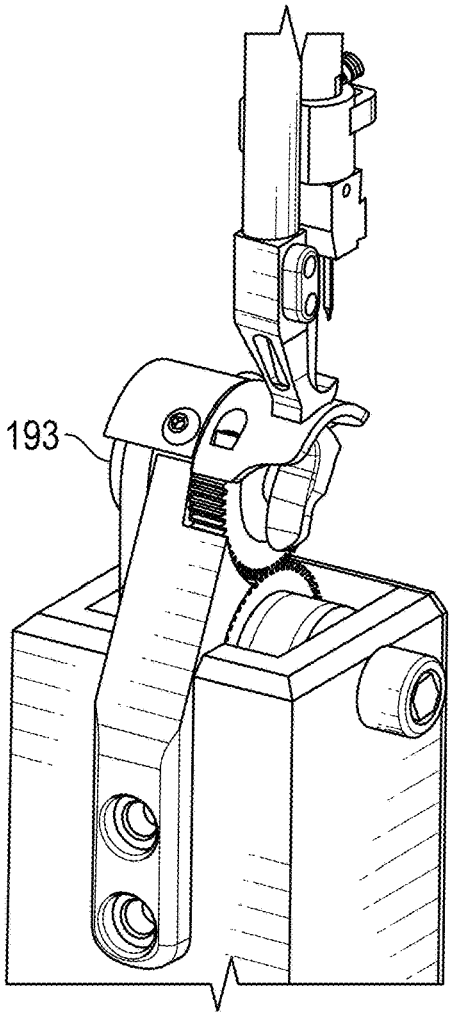

With continued reference to FIG. 2 and with additional reference to FIGS. 3A, 3B and 3C, the second drivetrain 190 drives the butterfly looper 170 and is connected to bevel gear 191 mounted to the horizontal mid-shaft 144. The second drivetrain 190 includes a set of interconnected bevel shafts 192 that are driven by the bevel gear 191, a pulley 193, a belt 194 that transfers rotation from the set of interconnected bevel shafts 192 to the pulley 193, a stitch plate support and pulley casing 1945 and gearing 195. The butterfly looper 170 is driven off the pulley 193 that in turn is driven by the belt 194. The butterfly looper 170 is supported by the stitch plate 160, which maintains its rotational position relative to the sewing needle 121, the foot 122 and rest of the sewing head body 110 via the gearing 195. The stitch plate 160 is mounted to the lower arm 150 by a structural component 196 that includes a bearing 197 that allows the stitch plate 160 to rotate while being constrained in multiple axis. A sheet metal shield 198 prevents material from touching the pulley 193.

Figure 4:
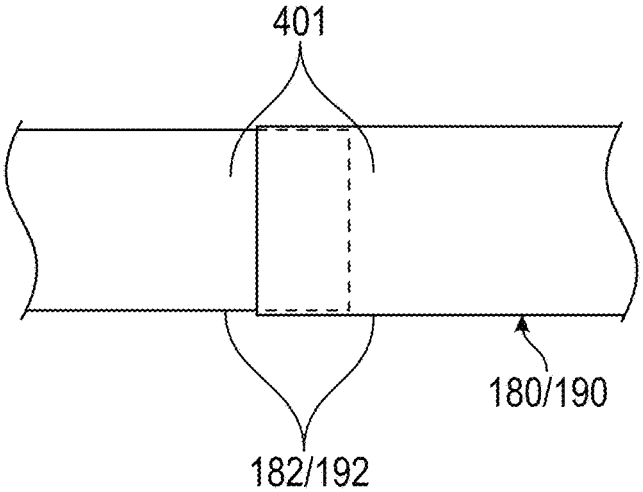
FIG. 4 is a side schematic diagram of concentric shafts of drivetrains of the robotic sewing assembly of FIGS. 1 and 2 in accordance with embodiments.

With reference to FIG. 4 and in accordance with embodiments, at least one of the first drivetrain 180 and the second drivetrain 190 can include concentric shafts 401 to reduce spatial requirements. That is, for the first drivetrain 180, at least a portion of the set of interconnected shafts 182 can include or be provided as the concentric shafts 401 and, for the second drivetrain 190, at least a portion of the set of interconnected bevel shafts 192 can include or be provided as the concentric shafts 401.

Figure 5:
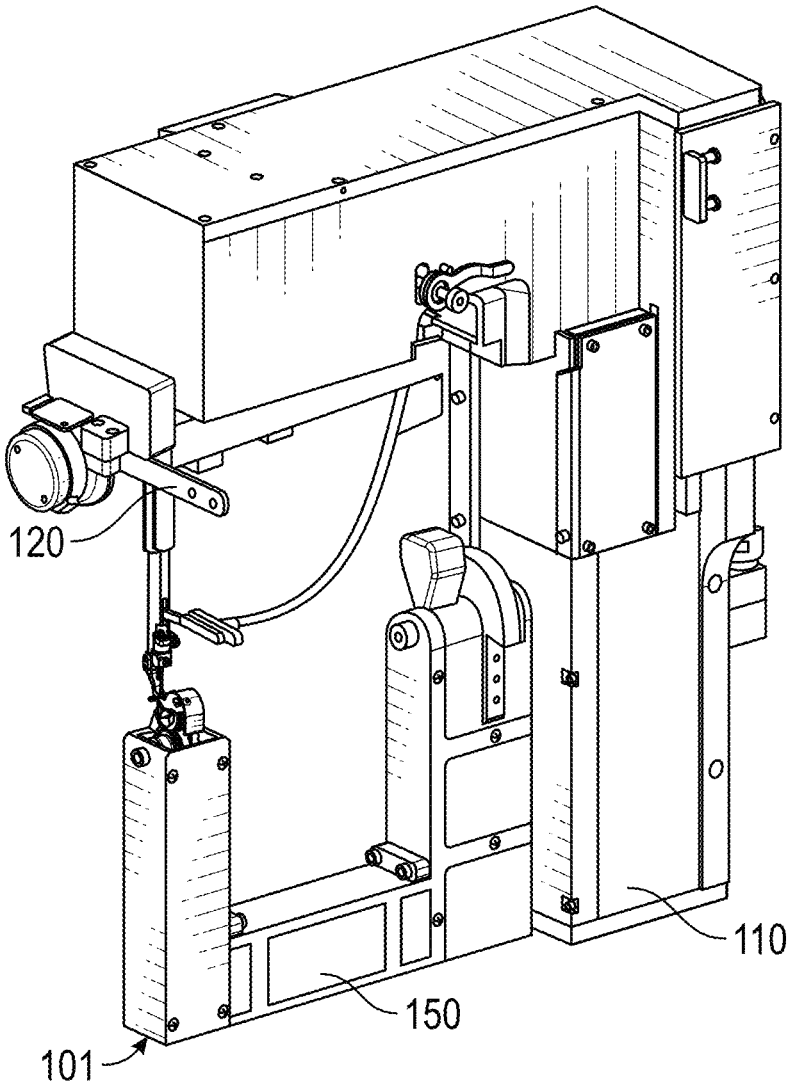
FIG. 5 is a perspective view of the robotic sewing assembly including the rotatable lower arm of FIGS. 1 and 2 with a counterweight in accordance with embodiments.

With reference to FIG. 5 and in accordance with embodiments, the robotic sewing assembly 101 can further include a counterweight 501 (the motor 130 has been removed for clarity). The counterweight 501 can be disposed on the lower arm 150 and can be configured to effectively reduce a torque requirement associated with rotation of the lower arm 150. The counterweight 501 can be oriented to not invade the substantially empty internal sewing region 201 or to limit invading the substantially empty internal sewing region 201 to a practical extent.

Figure 6:
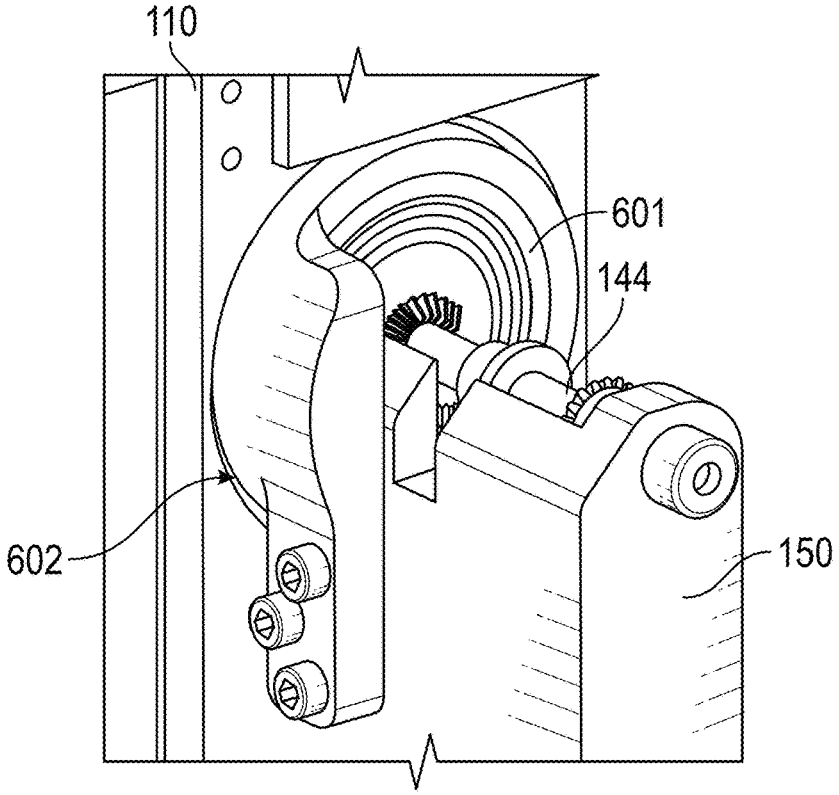
FIG. 6 is a perspective view of the robotic sewing assembly including the rotatable lower arm of FIGS. 1 and 2 with a bearing and a support element in accordance with embodiments.

With reference to FIG. 6 and in accordance with embodiments, the robotic sewing assembly 101 can further include a bearing 601 with a support element 602 that are supportively disposable on the sewing head body 110 for support of the lower arm 150 against the sewing head body 110. The bearing 601 and the support element 602 permit the rotation of the lower arm 150 and can be disposed about the horizontal mid-shaft 144. In this configuration, the bearing element 601 and the support 602 effectively replace a reliance of the lower arm 150 being mounted on the horizontal mid-shaft 144.

Figure 7:
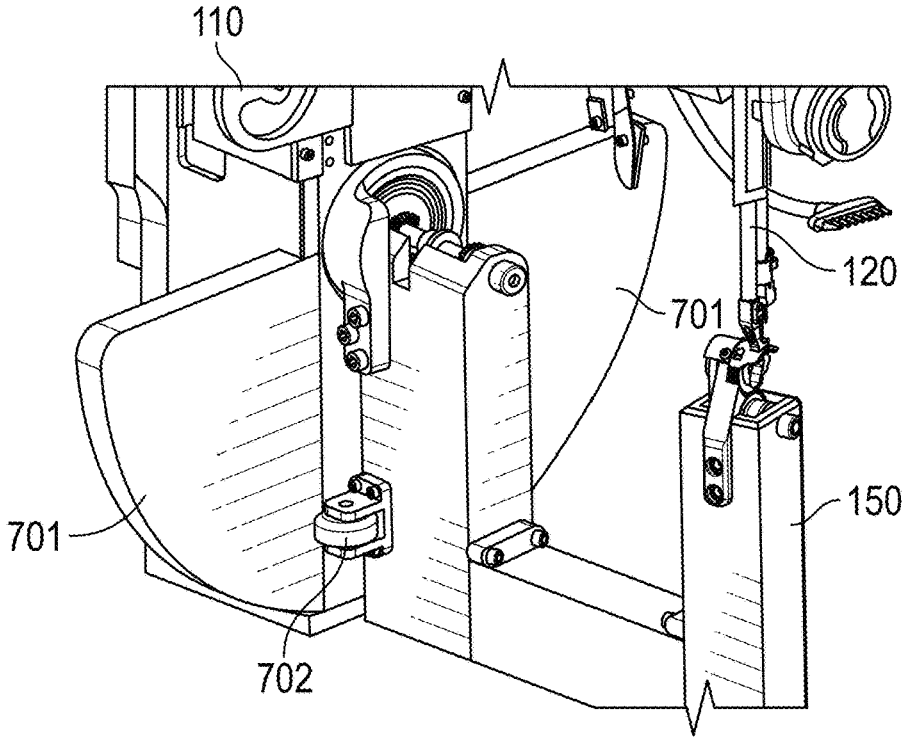
FIG. 7 is a perspective view of the robotic sewing assembly including the rotatable lower arm of FIGS. 1 and 2 with wings and roller bearings in accordance with embodiments.

With reference to FIG. 7 and in accordance with embodiments, the robotic sewing assembly 101 can further include wings 701 extending outwardly in opposite directions from the sewing head body 110 to define a plane of support for the rotation of the lower arm 150 and roller bearings 702. The roller bearings 702 are attachable to the lower arm 150 and provide for support of the lower arm 150 against the wings 701 during the rotation of the lower arm 150. The rotational length of the wings 701 can be at least sufficient to support the full rotational capability of the lower arm 150. Thus, where the lower arm 150 can be rotated clockwise through up to 80 degrees of rotation or more about the second axis A2 from the center position, one of the wings 701 extends far enough to support the entirety of the clockwise rotation of the lower arm 150 and, where the lower arm 150 can be rotated counter-clockwise through up to 80 degrees of rotation or more about the second axis A2 from the center position, the other one of the wings 701 extends far enough to support the entirety of the counter-clockwise rotation of the lower arm 150.

Figure 8:
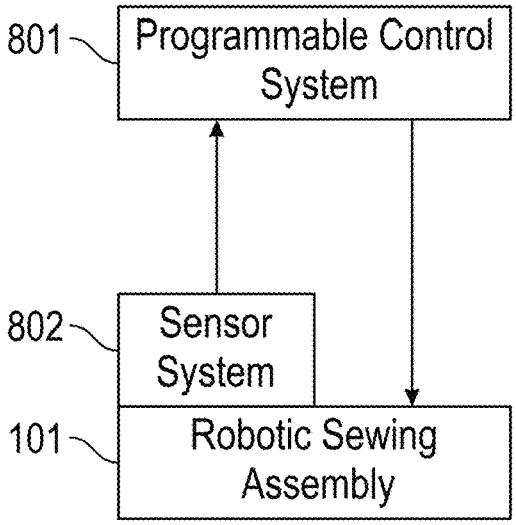
FIG. 8 is a schematic diagram of a robotic sewing assembly, a programmable control system and a sensor system in accordance with embodiments.

With reference to FIG. 8, the robotic sewing assembly 101 can include a programmable control system 801 and the programmable control system 801 can include a sensor system 802. The programmable control system 801 can include a processing unit, a memory for storing executable instructions that are readable and executable by the processing unit whereby the processing unit controls operations of the robotic sewing assembly 101 in accordance with readings of the sensor system 802 and an input/output (I/O) unit by which the processing unit is communicative with the robotic sewing assembly 101 and the sensor system 802. The programmable control system 801 can thus be configured to robotically control the sewing head body 110, the upper arm 120, the sewing needle 121, the lower arm 150, the rotation of the lower arm 150 and the respective operations of the first drivetrain 180 and the second drivetrain 190 without operator involvement. The sensor system 802 can be configured to gage distance between the lower arm 150 and the article being sewn. The programmable control system 801 can be further configured to modify a programmed operation of the sewing head body 110, the upper arm 120, the sewing needle 121, the lower arm 150, the rotation of the lower arm 150 and the respective operations of the first drivetrain 180 and the second drivetrain 190 in accordance with readings of the sensor system 802. For example, to an extent that a size, a shape and/or a configuration of the article being sewn departs from a nominal size, shape and/or configuration whereby some portion of robotic sewing assembly 101 is at risk of impacting the article during sewing, the sensor system 802 will be able to detect a possible impact and the programmable control system 801, upon being alerted of the possible impact by the sensor system 802, will be able to modify the programmed operation to avoid the possible impact.

While the various embodiments described above have been described separately, it is to be understood that they can be combined together in various combinations. It is to be further understood that other configurations besides those described above are possible. For example, the motor 130 and the lower arm rotation drivetrain 140 can be replaced by motorizing the roller bearings 702 of FIG. 7, which will in turn allow for corresponding modifications to the first drivetrain 180 and the second drivetrain 190.

Figure 9:
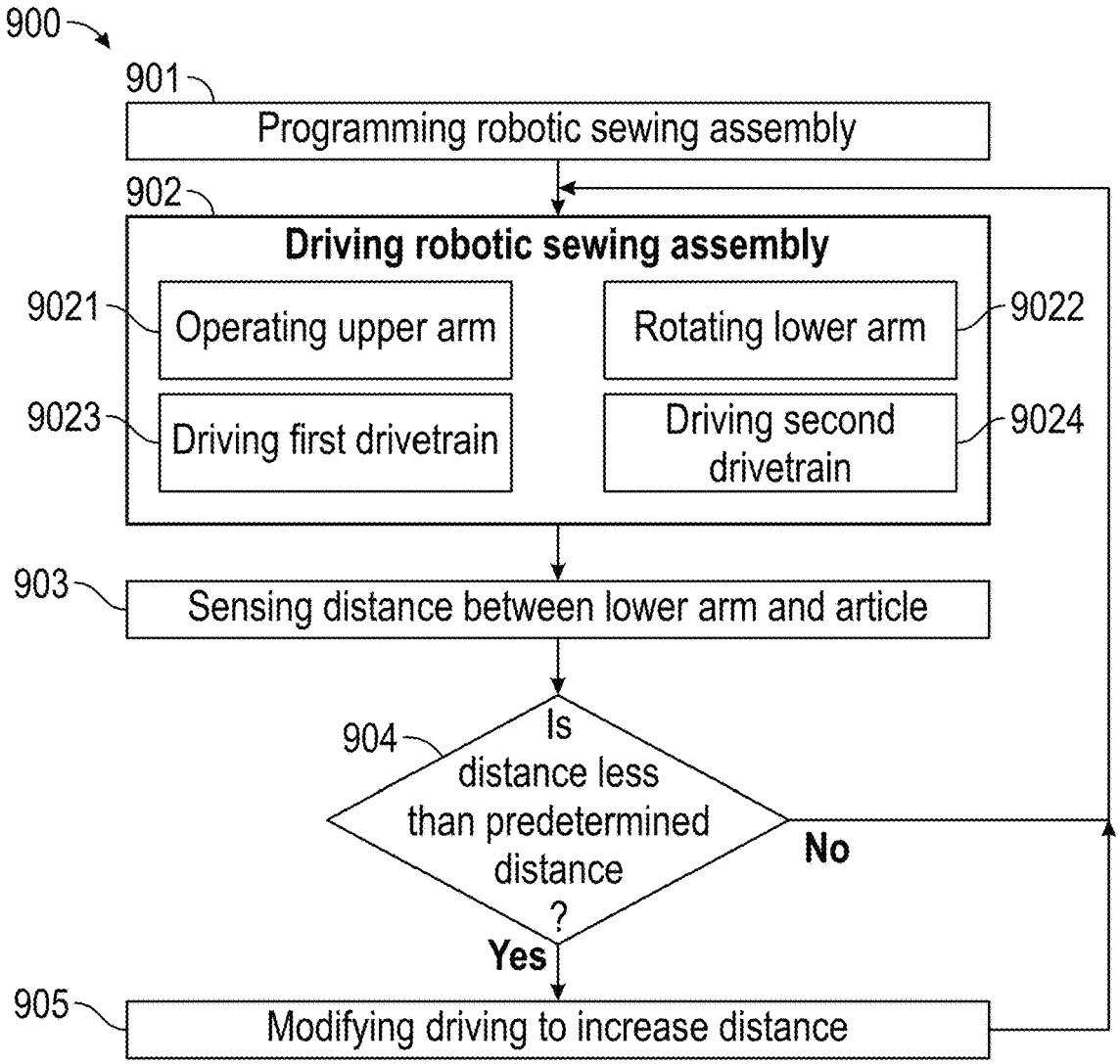
FIG. 9 is a flow diagram illustrating a method of operating a robotic sewing assembly in accordance with embodiments.

With reference to FIG. 9, a method 900 of operating a robotic sewing assembly, such as the robotic sewing assembly 101 described above, is provided. As shown in FIG. 9, the method 900 can include programming the robotic sewing assembly to execute a sewing operation with respect to an article (block 901) and driving the robotic sewing assembly in accordance with the programming (block 902). The driving of block 902 can include operating an upper arm including a sewing needle oriented along a first axis (block 9021), rotating a lower arm about a second axis defined transversely with respect to the first axis (block 9022), driving a first drivetrain extending through the lower arm to maintain a position of a stitch plate of the lower arm during the rotating of the lower arm (block 9023) and driving a second drivetrain extending through the lower arm to drive a looper of the lower arm during the rotating of the lower arm (block 9024). In accordance with further embodiments, the method 900 can further include sensing a distance between the lower arm and the article (block 903), determining whether the distance is less than a predetermined distance such that there is a risk of a possible impact as described above (block 904) and, in an event the distance is less than the predetermined distance, modifying the driving of block 902 in accordance with the programming to increase the distance (block 905).

Technical effects and benefits of the present disclosure are the provision of a robotic sewing assembly that is capable of sewing complex 3D planar parts. The robotic sewing assembly has a rotatable lower arm that makes it possible to rotate the lower arm while maintaining stitch plate position relative to the upper portion of the sewing assembly and while actively sewing a part. Thus, as the part is being sewn, the lower arm can be maneuvered and repositioned to optimize the sewing assembly to fit the part geometry.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A robotic sewing assembly, comprising:

a sewing head body;

an upper arm attachable to the sewing head body and comprising a sewing needle oriented along a first axis;

a motor; and a lower arm rotatably attachable to the sewing head body to be rotatable about a second axis defined transversely with respect to the first axis by the motor, the lower arm comprising:

a stitch plate;

a butterfly looper;

a first drivetrain extendable through the lower arm and being configured to maintain a position of the stitch plate during lower arm rotation; and a second drivetrain extendable through the lower arm and being configured to drive the butterfly looper during the lower arm rotation.

2. The robotic sewing assembly according to claim 1, wherein the upper arm, the sewing needle and the lower arm define an empty internal sewing region.

3. The robotic sewing assembly according to claim 1, wherein the lower arm is rotatable through 160 degrees of rotation about the second axis.

4. The robotic sewing assembly according to claim 1, wherein the lower arm and the first and second drivetrains are correspondingly U-shaped.

5. The robotic sewing assembly according to claim 1, wherein at least one of the first and second drivetrains comprises concentric shafts.

6. The robotic sewing assembly according to claim 1, further comprising a counterweight disposable to reduce a lower arm torque requirement.

7. The robotic sewing assembly according to claim 1, further comprising a bearing supportively disposable on the sewing head body for lower arm support against the sewing head body.

8. The robotic sewing assembly according to claim 1, further comprising:

wings extendable outwardly from the sewing head body; and roller bearings attachable to the lower arm for lower arm support against the wings during the lower arm rotation.

9. The robotic sewing assembly according to claim 1, further comprising a programmable control system configured to robotically control the sewing head body, the upper arm, the lower arm and the lower arm rotation, wherein:

the programmable control system comprises a sensor system to gage distance between the lower arm and an article being sewn, and the programmable control system is configured to modify a programmed operation of the sewing head body, the upper arm, the lower arm and the lower arm rotation in accordance with readings of the sensor system.

10. A robotic sewing assembly, comprising:

a sewing head body;

an upper arm attachable to the sewing head body and comprising a sewing needle oriented along a first axis;

a motor;

a lower arm rotation drivetrain; and a lower arm rotatably attachable to the sewing head body to be rotatable about a second axis defined transversely with respect to the first axis by the motor via the lower arm rotation drivetrain, the lower arm comprising:

a stitch plate;

a butterfly looper;

a first drivetrain extendable through the lower arm and being configured to maintain a position of the stitch plate during lower arm rotation; and a second drivetrain extendable through the lower arm and being configured to drive the butterfly looper during the lower arm rotation.

11. The robotic sewing assembly according to claim 10, wherein the upper arm, the sewing needle and the lower arm define an empty internal sewing region.

12. The robotic sewing assembly according to claim 10, wherein the lower arm is rotatable through 160 degrees of rotation about the second axis.

13. The robotic sewing assembly according to claim 10, wherein the lower arm and the first and second drivetrains are correspondingly U-shaped.

14. The robotic sewing assembly according to claim 10, wherein at least one of the first and second drivetrains comprises concentric shafts.

15. The robotic sewing assembly according to claim 10, further comprising a counterweight disposable to reduce a lower arm torque requirement.

16. The robotic sewing assembly according to claim 10, further comprising a bearing supportively disposable on the sewing head body for lower arm support against the sewing head body.

17. The robotic sewing assembly according to claim 10, further comprising:

wings extendable outwardly from the sewing head body; and roller bearings attachable to the lower arm for lower arm support against the wings during the lower arm rotation.

18. The robotic sewing assembly according to claim 10, further comprising a programmable control system configured to robotically control the sewing head body, the upper arm, the lower arm and the lower arm rotation, wherein:

the programmable control system comprises a sensor system to gage distance between the lower arm and an article being sewn, and the programmable control system is configured to modify a programmed operation of the sewing head body, the upper arm, the lower arm and the lower arm rotation in accordance with readings of the sensor system.

19. A method of operating a robotic sewing assembly, the method comprising:

programming the robotic sewing assembly to execute a sewing operation with respect to an article; and driving the robotic sewing assembly in accordance with the programming, the driving comprising:

operating an upper arm comprising a sewing needle oriented along a first axis;

rotating a lower arm about a second axis defined transversely with respect to the first axis;

driving a first drivetrain extending through the lower arm to maintain a position of a stitch plate of the lower arm during the rotating of the lower arm; and driving a second drivetrain extending through the lower arm to drive a butterfly looper of the lower arm during the rotating of the lower arm.

20. The method according to claim 19, further comprising:

sensing a distance between the lower arm and the article;

determining whether the distance is less than a predetermined distance; and, in an event the distance is less than the predetermined distance, modifying the driving of the robotic sewing head in accordance with the programming to increase the distance.

* * * * *